US005085593A

United States Patent [19]

Tuan

[11] Patent Number: 5,085,593

[45] Date of Patent: Feb. 4, 1992

[54] ELASTICITY-ENHANCED CONTACT ELEMENT OF ELECTRICAL CONNECTOR

[76] Inventor: Kenny Tuan, 5F, No. 30, Lane 423, Yuan-San Rd., Chung-Ho City, Taipei Hsien, Taiwan

[21] Appl. No.: 640,807

[22] Filed: Jan. 14, 1991

[51] Int. Cl.[5] ..... H01R 23/70

[52] U.S. Cl. ..... 439/326

[58] Field of Search ..... 439/325-328, 439/629-637, 856, 858, 861, 862

[56] References Cited

U.S. PATENT DOCUMENTS

| | | | |
|---|---|---|---|
| 3,848,952 | 11/1974 | Tighe, Jr. | 439/326 |
| 4,737,120 | 4/1988 | Grabbe et al. | 439/636 |
| 4,957,448 | 9/1990 | Stanevich et al. | 439/326 |
| 4,960,386 | 10/1990 | Stanevich | 439/326 |
| 4,984,996 | 1/1991 | Watanable et al. | 439/326 |
| 4,998,890 | 3/1991 | Tuan | 439/326 |

*Primary Examiner*—Larry I. Schwartz
*Assistant Examiner*—Hien D. Vu

[57] ABSTRACT

A contact element of an electrical connector includes two spring contact members bifurcated from an intermediate pivot portion which is secured to a basic pivot portion by a pendulum arm member, in which an inner spring contact member is formed with a plurality of deflective spring bow portions interpolatively wound within a contour of an outer spring contact member which is formed with a plurality of deflective spring bow portions extrapolatively disposed around the inner spring contact member to prolong a force arm of each spring contact member to increase an elastic clamping force of the contact element in order for firmly clamping a printed circuit board between the two spring contact members for an efficient electrical connection of the printed circuit board.

2 Claims, 4 Drawing Sheets

ELASTICITY-ENHANCED CONTACT ELEMENT OF ELECTRICAL CONNECTOR

BACKGROUND OF THE INVENTION

Walse et al disclosed a low insertion force electrical connector with stress controlled contacts in their U.S. Pat. No. 4,575,172 including each spring contact of the connector formed with a C-shaped portion with opposed arcuate contacting portions for engaging the conductive strips of the printed circuit board.

The C-shaped portion 70 of Walse's connector includes two opposed arcuate beam members 72, 74 for clamping a printed circuit board for electrical connection purpose. However, each arcuate beam member 72 or 74 is too short to have a longer force arm for a stronger resilience force effected by the C-shaped portion. The elasticity caused by such a conventional connector is still limited, thereby affecting its clamping force and its electrical connection efficiency.

In view of U.S. Pat. No. 3,848,952 invented by Charles I. Tighe, an electrical contact 22 and a follower contact 24 bifurcated from a yoke 20 which is secured to a cantilever 26, 28 connected to a contact support 30 are provided to clamp a print circuit board 18. Even its yoke 20 as secured to the cantilever 26, 28 can serve as a buffer for clamping a printed circuit board with a wider range of thickness. However, the two clamping members of the contacts 22, 24 bifurcated from the yoke 20 are still too short, so that the resilient clamping force caused by the two short contacts 22, 24 is quite limited, thereby influencing an efficient electrical connection between the contacts 22, 24 and the board 18.

It is therefore expected to further prolong a length of each spring contact of the two contacts clamping the printed circuit board to increase a force arm of an elastic force caused by the spring contacts in order to increase its clamping force of a contact element of an electrical connector.

SUMMARY OF THE INVENTION

The object of the present invention is to provide a contact element of an electrical connector having two spring contact members bifurcated from an intermediate pivot portion which is secured to a basic pivot portion by a pendulum arm member, in which an inner spring contact member is formed with a plurality of deflective spring bow portions interpolatively wound within a contour of an outer spring contact member which is formed with a plurality of deflective spring bow portions extrapolatively disposed around the inner spring contact member to prolong a force arm of each spring contact member to increase an elastic clamping force of the contact element in order for firmly clamping a printed circuit board between the two spring contact members for an efficient electrical connection of the printed circuit board.

DETAILED DESCRIPTION

Figure 1:
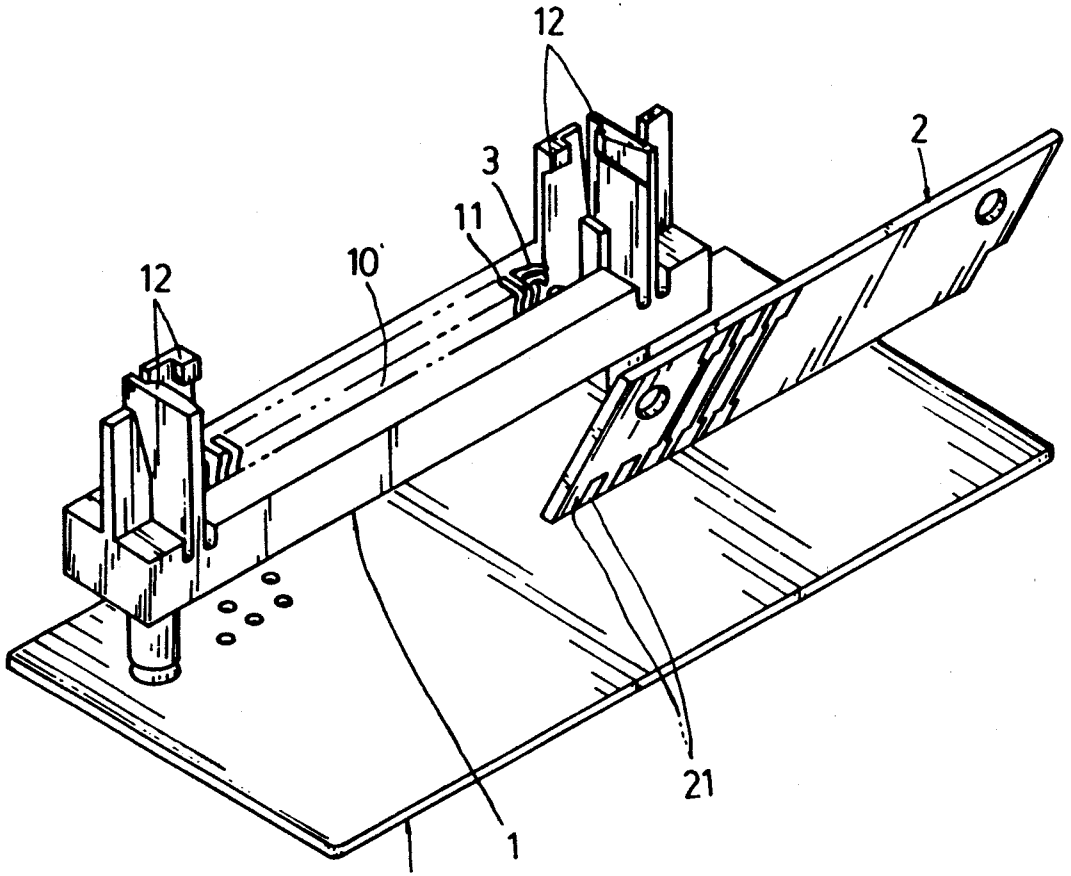
FIG. 1 is a perspective view of an electrical connector fitted with the present invention.

As shown in FIG. 1, the present invention comprises a plurality of contact elements 3 respectively inserted in a plurality of slots 11 transversely formed in an elongate socket 10 longitudinally formed in a connector base 1 secured with a mother board 4 for connecting a daughter printed circuit board 2 inserted in the socket 10 to be clamped and held by the plurality of contact elements 3 of the present invention. The daughter printed circuit board 2, having conducting areas 21 formed on two lower edges of the daughter board 2 to be clamped by the contact element 3, is mounted on the connector base 1 as retained between a pair of fixing protrusions 12 respectively formed on two opposite end portions of the connector base 1. The contact element 3 of the present invention is formed as a thin-plate made of electrically conductive materials.

Figure 2:
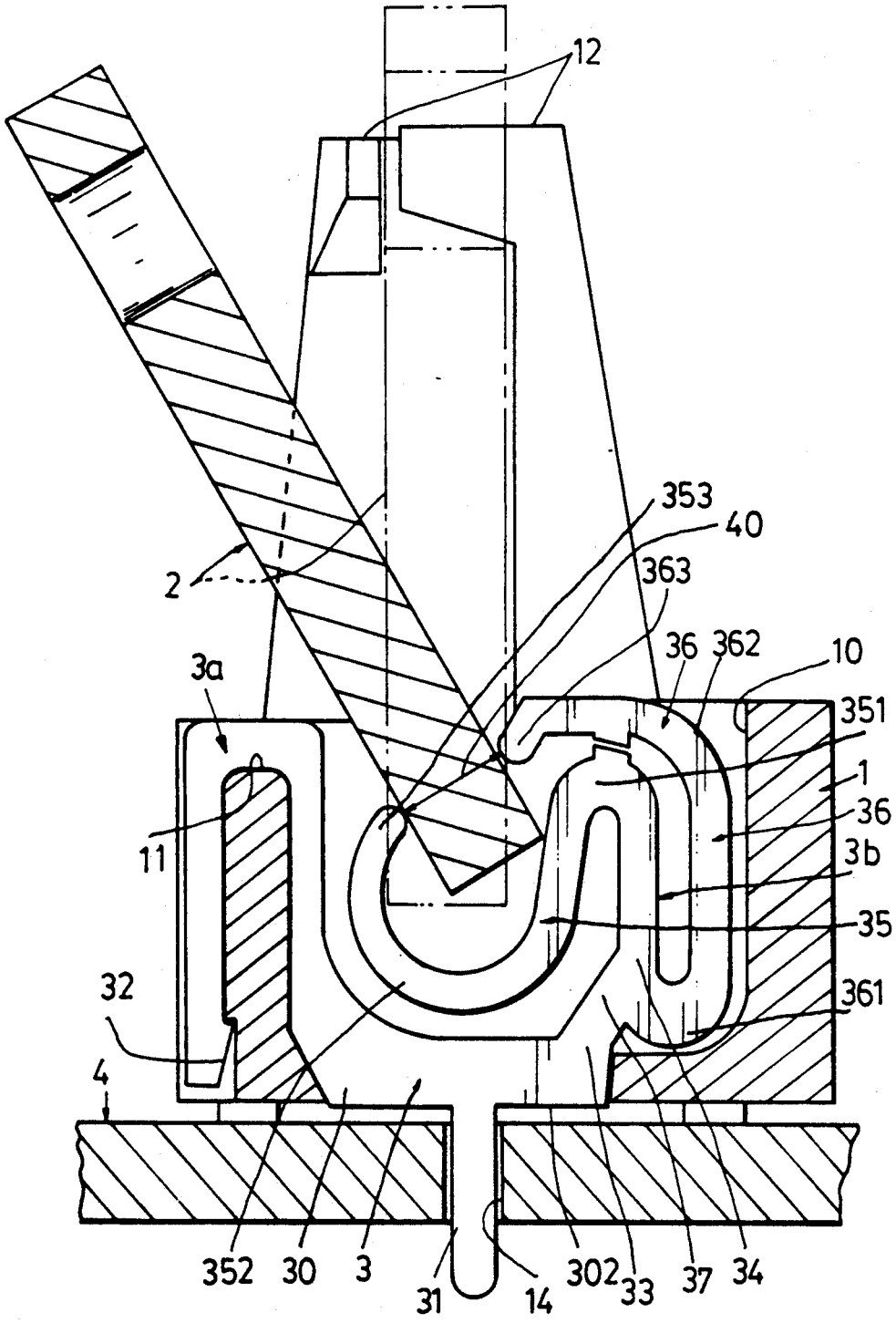
FIG. 2 is a sectional drawing of the present invention.

As shown in FIG. 2, the contact element 3 of the present invention comprises: a base portion 30 having a supporting leg member 31 protruding downwardly from a bottom surface 302 of the base portion 30 through a leg hole 14 formed in the mother board 4, an embedding portion **3*a* formed on one side of the base portion 30 having an engaging end portion 32 made as a ratchet tooth or wedge portion to be engaged with the slot 11 formed in the connector base 1, and a clamping portion 3*b* formed on the other side of the base portion 30 held in the socket 10 in the connector base 1 for clamping the daughter board 2**.

The clamping portion **3*b* of the contact element 3 includes: a pendulum arm member 37 secured to a basic pivot portion 33 formed on the base portion 30 of the contact element 3, an intermediate pivot portion 34 secured on an extended end portion of the pendulum arm member 37 opposite to the basic pivot portion 33, a first spring contact member 35 which is bifurcated inwardly from the intermediate pivot portion 34 and is interpolatively wound to form a plurality of inner deflective spring bow portions 351, 352 along a winding path of the contact member 35 and formed with a first contact protrusion 353 on an upper end portion of the contact member 35, and a second spring contact member 36 which is bifurcated outwardly from the intermediate pivot portion 34 to form a plurality of outer deflective spring bow portions 361, 362 along another winding path of the second contact member 36 and formed with a second contact protrusion 363 on an upper end portion of the second contact member 36 oppositely facing the first contact prptrusion 353 for clamping the daughter board 2 by defining an aperture 40 between the two contact protrusions 353, 363**.

The second spring contact member 36 is extrapolatively wound to form the deflective spring bow portions 361, 362 to generally surround the first spring contact member 35, thereby almost thoroughly occupying a space in the socket 10 of the connector base 1 by approximating the first contact member 35 to the second contact member 36.

Therefore, each spring contact member 35 or 36 can be prolonged its length as much as possible to increase a force arm of an elastic force effected by the contact element 3 for greatly increasing a clamping force of the two contact members 35, 36.

Each deflective spring bow portions 351, 352, 361, 362 is arcuately bent to form an angle like a "bow" to store a potential resilience helpful for clamping the daughter board 2.

When a daughter board 2 is inserted into the socket 10 of the connector base 1 to be clamped by the two contact members 35, 36, each contact member 35 or 36 is deflectively wound to increase its force arm of an elastic clamping force, thereby increasing the clamping force of the two contact protrusions 353, 363.

When the clamped board 2 is vertically erected as shown in FIG. 2, a movement in response to the stress acted by an external force of an operator for rotating the clamping board 2 and the contact element 3 of the present invention will be focused at the intermediate pivot portion 34, thereby without influencing the clamping effect of the two protrusions 353, 363 of the two contact members 35, 36.

The intermediate pivot portion 34 and the secured pendulum arm member 37 will also serve as a buffer for soothing the stress caused by an unsuitable external force acting on the contact element 3 of the electrical connector.

For instance, if an external force is much concentrated at the first contact protrusion 353, the intermediate pivot portion 34 will be lowered initially; and if the external force is much concentrated at the second contact protrusion 363, the pivot portion 34 will be relatively raised. After the daughter board 2 is stably clamped by the two protrusions 353, 363, the pendulum arm member 37 between the intermediate pivot portion 34 and the basic pivot portion 33 will be self-adjusted to restore the intermediate pivot portion 34 to a normal position. Therefore, every daughter board 2 after being stably posed (either vertically or inclinedly fixed) may obtain an equal height due to the self-adjustment function of the pendulum arm member 37 and the pivot portions 34, 33. The longer spring contact members 35, 36 may increase their elastic clamping force for firmly clamping the board 2.

Figure 3:
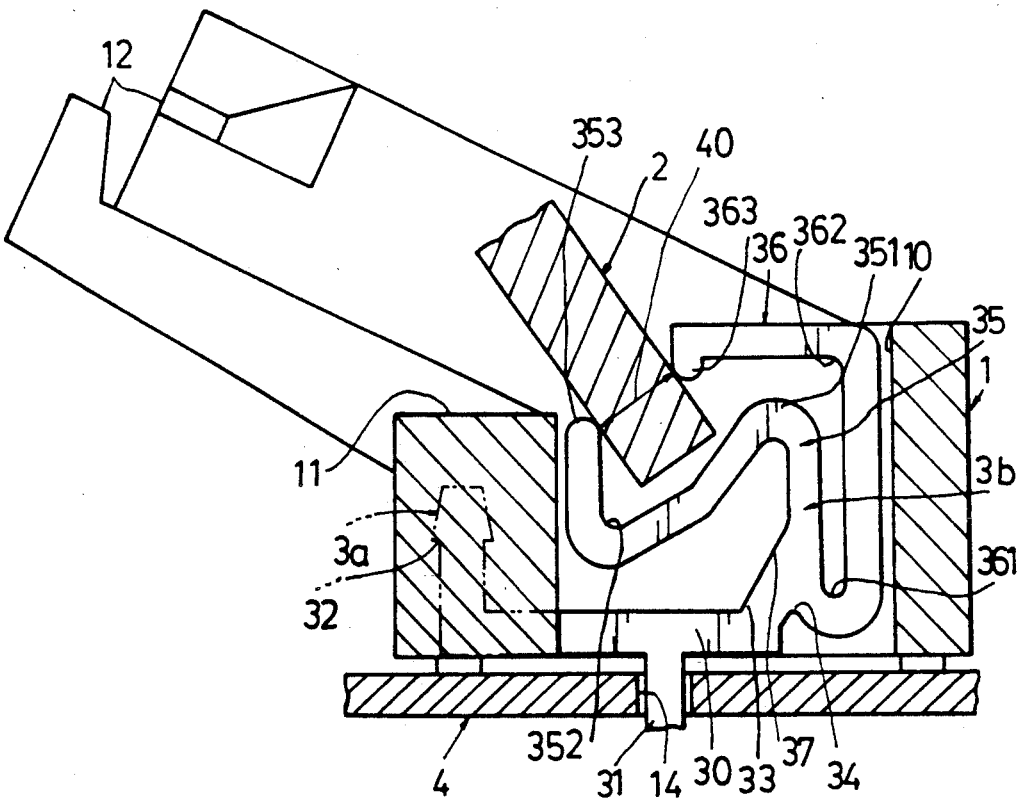
FIG. 3 shows a modified contact element of the present invention for inclinedly posing a printed circuit board.
Figure 4:
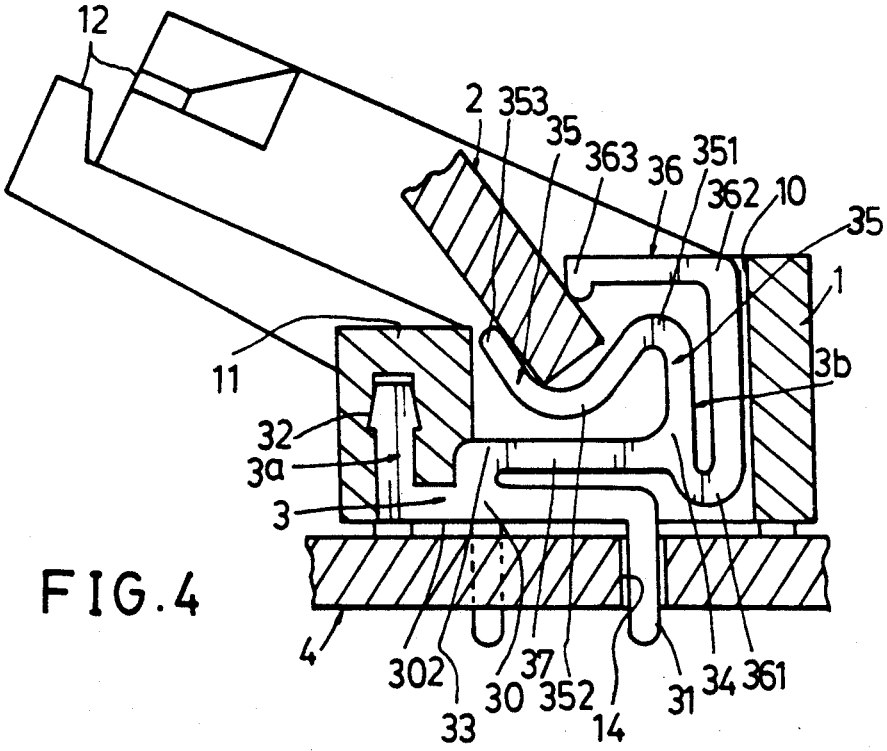
FIG. 4 shows another preferred embodiment of the present invention.
Figure 5:
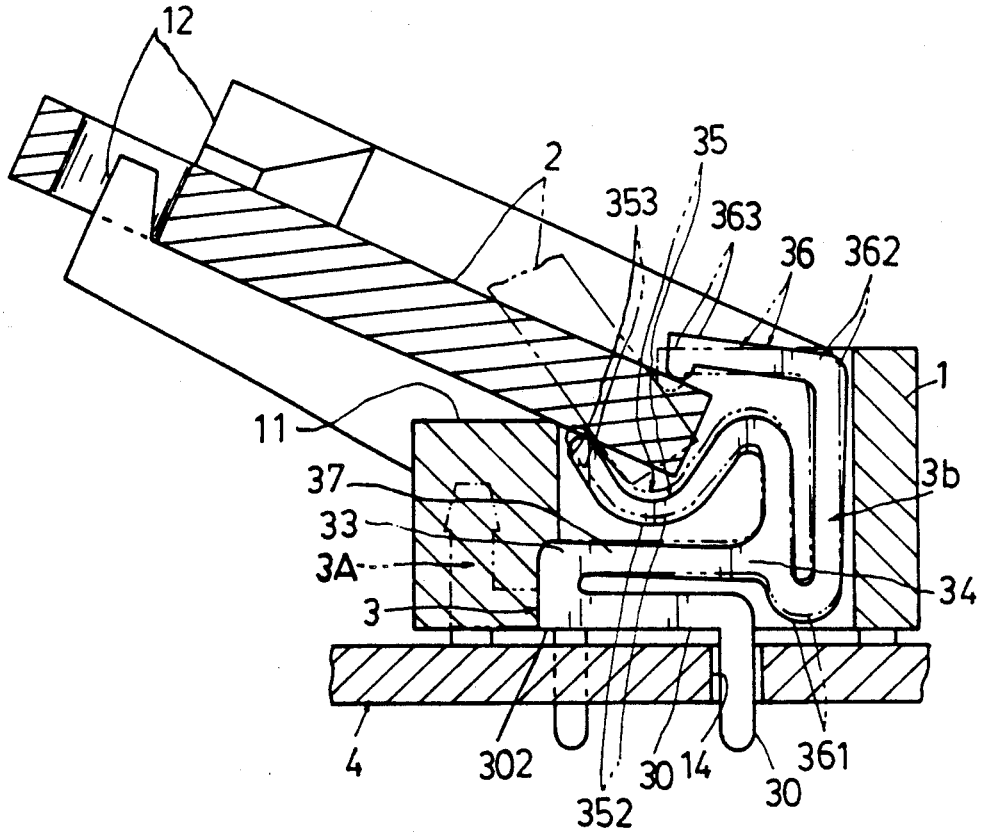
FIG. 5 shows a fixing operation for inclinedly posing a board in accordance with the present invention as shown in FIG. 4.

As shown in FIGS. 4, 5, the pendulum arm member 37 between the two pivot portions 34, 33 may be prolonged from that as shown in FIGS. 2, 3.

Figure 6:
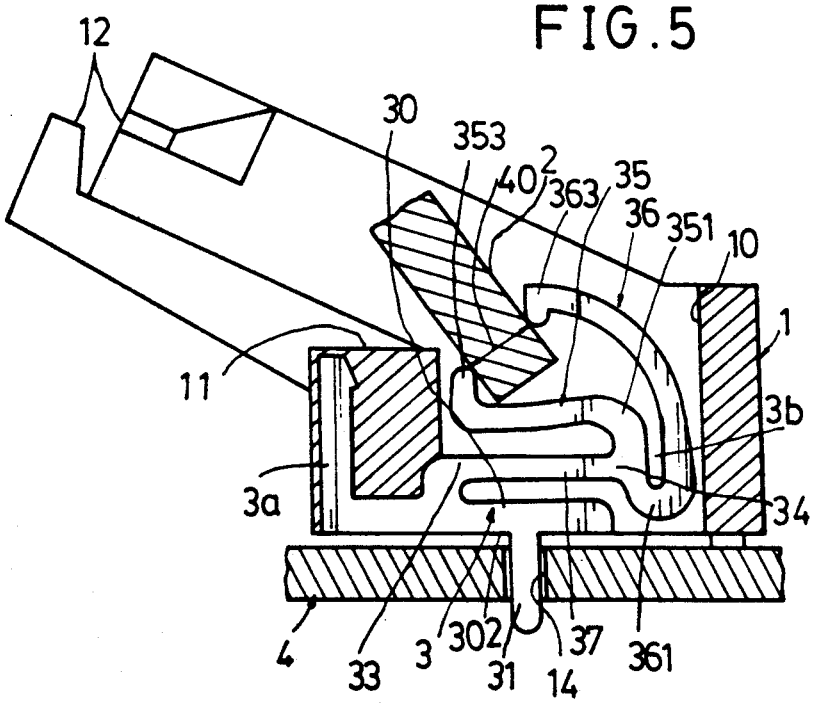
FIG. 6 shows still another preferred embodiment of the present invention.

In FIG. 6, the plurality of the deflective spring bow portions 351, 352, 361, 362 of either contact member 35 or 36 can be simplified to be a single deflective spring bow portion 351 or 361 formed in either contact member 35 or 36.

The bending angle of each deflective spring bow portion 351, 361 in this invention is not limited. The shapes of the clamping portion 36 and the structure of the embedding portion 3*a* of the present invention are also not limited in this invention.

The present invention is superior to a conventional electrical connector with the following advantages:

1. By providing the plurality of deflective spring bow portions 351, 361 in the two spring contact members 35, 36 for interpolating the contact member 35 and extrapolating the contact member 36, the force arm of an elastic clamping force of the two contact members 35, 36 can be much increased for firmly clamping a daughter board.

2. The prolonged contact members 35, 36, the pendulum arm member 37 and the pivot portions 34, 33 will serve as a buffer to soothe any stress caused by an external force by an operator, and may be adapted for a wide range of tolerances suitable for inserting thicker daughter board.

3. The space in the socket of a connector base 1 is efficiently used.

4. The embedding portion 3*a* is separated from the clamping portion 3*b* so that when rotating a clamped board 2 for fixedly posing the board 2, the clamping portion 3*b* will not be released from the connector base 1.

5. Only a left end portion of the contact element 3, i.e., the embedding portion 3*a* is engaged with the left slot 11 formed on a left side of the connector base 1, so that when subjected to a high temperature, no stress will be built in the slot or socket of the connector base 1 for preventing a permanent set of the contact element.

6. Plural contact elements when inserted with the daughter board will be self-adjusted to an equal height to homogeneously distribute the clamping force to the two spring contact members 35, 36 for preventing a poor electrical connection of the printed circuit boards.

It is claimed:

1. In an electrical connector comprising a connector base having an elongate socket longitudinally formed in the connector base, a plurality of slots transversely formed in said elongate socket for receiving a plurality of contact elements therein, a daughter printed circuit board inserted through the socket to be clamped by the plurality of the contact elements for connecting the daughter board to a mother board secured to the connector base; each said contact element including:

a base portion having a supporting leg member protruding downwardly from said base portion to be fixed in the mother board;

an embedding portion formed on a first side of said base portion engaged with the slot formd in said connector base; and a clamping portion formed on a second side of said base portion opposite to said embedding portion for clamping said daughter board;

the improvement which comprises:

said clamping portion of said contact element including: a pendulum arm member secured to a basic pivot portion formed on said base portion; and intermediate pivot portion secured to an extended end portion of said pendulum arm member opposite to said basic pivot portion;

a first spring contact member bifurcated inwardly from said intermediate pivot portion and interpolatively wound to form a plurality of inner deflective spring bow portions arcuately bent along a first winding path of said first spring contact member, and formed with a first contact protrusion on an upper end portion of said first spring contact member; and a second spring contact member bifurcated outwardly from the intermediate pivot portion and extrapolatively wound to form a plurality of outer deflective spring bow portions arcuately bent along a second winding path of said second spring contact member to generally surround said first spring contact member within the socket in said connector base, and formed with a second contact protrusion on an upper end portion of said second spring contact member oppositely facing said first contact protrusion for clamping the daughter board therebetween.

2. In an electrical connector comprising a connector base having an elongate socket longitudinally formed in the connector base, a plurality of slots transversely formd in said elongate socket for receiving a plurality of contact elements therein, a daughter printed circuit board inserted through the socket to be clamped by the plurality of the contact elements for connecting the daughter board to a mother board secured to the connector base; each said contact element including:

a base portion having a supporting leg member protruding downwardly from said base portion to be fixed in the mother board;

an embedding portion formed on a first side of said base portion engaged with the slot formd in said connector base; and a clamping portion formed on a second side of said base portion opposite to said embedding portion for clamping said daughter board;

the improvement which comprises:

said clamping portion of said contact element including:

a pendulum arm member secured to a basic pivot portion formed on said base portion; an intermediate pivot portion secured to an extended end portion of said pendulum arm member opposite to said basic pivot portion;

a first spring contact member bifurcated inwardly from said intermediate pivot portion and interpolatively wound to form a plurality of inner deflective spring bow portions arcuately bent along a first winding path of said first spring contact member, and formed with a first contact protrusion on an upper end portion of said first spring contact member; and a second spring contact member bifurcated outwardly from the intermediate pivot portion and extrapolatively wound to form an outer deflective spring bow portion arcuately bent along a second winding path of said second spring contact member to generally surround said first spring contact member within the socket in said connector base, and formed with a second contact protrusion on an upper end portion of said second spring contact member oppositely facing said first contact protrusion for clamping the daughter board therebetween.

* * * * *